US005114541A

United States Patent [19]

Bayer

[11] Patent Number: 5,114,541

[45] Date of Patent: May 19, 1992

[54] PROCESS FOR PRODUCING SOLID, LIQUID AND GASEOUS FUELS FROM ORGANIC STARTING MATERIAL

[76] Inventor: Ernst Bayer, 74 Tübingen, Bei der Ochsenweide 17, Fed. Rep. of Germany

[21] Appl. No.: 698,897

[22] Filed: May 13, 1991

Related U.S. Application Data

[63] Continuation of Ser. No. 123,220, Nov. 20, 1987, abandoned, which is a continuation of Ser. No. 504,231, Jun. 14, 1983, abandoned, which is a continuation of Ser. No. 319,884, Nov. 10, 1981, abandoned.

[30] Foreign Application Priority Data

Nov. 14, 1980 [DE] Fed. Rep. of Germany ..... 3042964

[51] Int. Cl.[5] ..... C10B 53/00; C10B 57/14

[52] U.S. Cl. ..... 201/2.5; 44/605; 48/197 A; 201/25; 585/240

[58] Field of Search ..... 201/2.5, 25; 585/240, 585/241; 48/197 A, 209; 44/605

[56] References Cited

U.S. PATENT DOCUMENTS 3,962,044 6/1976 Mackenzie ..... 201/2.5

4,300,009 11/1981 Haag et al. ..... 585/240

*Primary Examiner*—Joye L. Woodard

*Attorney, Agent, or Firm*—Bacon & Thomas

[57] ABSTRACT

A process for producing solid, liquid and gaseous fuels comprising the use of an organic starting material selected from a bio-mass of microbial, vegetable or animal origin and sediments or garbage containing organic material, heating said organic material under the exclusion of air slowly to a conversion temperature of 200° to 600° C., conducting the gases and vapors escaping during the heating through suitable gas and liquid separators, maintaining the conversion temperature until the development of gases and vapors has substantially ceased, and isolating the solid conversion residues and the separated gases and liquids.

16 Claims, No Drawings

PROCESS FOR PRODUCING SOLID, LIQUID AND GASEOUS FUELS FROM ORGANIC STARTING MATERIAL

This application is a continuation of application Ser. No. 07/123,220, filed Nov. 20, 1987, which is a continuation of Ser. No. 06/504,231, filed Jun. 14, 1983, which is a continuation of Ser. No. 06/319,884, filed Nov. 10, 1981, all of which are now abandoned.

BACKGROUND OF THE INVENTION

1. Field of the Invention

The invention relates to a process for producing solid, gaseous and liquid fuels from organic starting material.

2. Description of the Prior Art

Nowadays solid and liquid fuels are mainly obtained from fossil energy sources, such as coal and petroleum. Also the synthetic processes for obtaining hydrocarbons, for instance the coal hydrogenation according to Pier and Bergius or the so-called Fischer-Tropsch process, start out from these fossil fuels, especially from coal.

It is believed nowadays that coal originated mainly from vegetable material with a high content of cellulose and that petroleum originated from a mass of bacteriae. Bacteriae consist of up to 60 to 80% out of proteins and lipids. During the formation of petroleum the hetero-functional groups originally being present in the natural material, especially the nitrogen, sulfur, and oxygen hetero-functional groups must have been eliminated from these substances. This must have happened under conditions under which no carbon-carbon bonds were cleaved and no oxidative or reductive processes were necessary. It was not possible up to now to copy this believed "natural" course of reaction. In particular no process has been found being capable to convert organic material, especially organic material of vegetable or animal origin at normal pressure and without using reductive or oxidative processes into solid or liquid fuels.

OBJECTS OF THE INVENTION

It is an object of the invention to provide a process for producing solid, liquid and gaseous fuels which does not require the use of fossil energy sources but allows the conversion of bio-mass of microbial, vegetable or animal origin and of sediments or garbage containing organic material at normal pressure and without using reduction and oxidation processes.

DETAILED DESCRIPTION OF THE INVENTION

The present invention provides a novel process for producing solid, liquid and gaseous fuels comprising the use of an organic starting material selected from biomass of microbial, vegetable or animal origin and sediments or garbage containing organic material, heating said organic material under the exclusion of air slowly to a conversion temperature of 200° to 600° C., conducting the gases and vapors escaping during the heating through suitable separators for gases and liquids, maintaining the conversion temperature until the development of gases and vapors has substantially ceased, and isolating the solid conversion residues and the separated gases and liquids.

Preferably carbohydrates, lipids, proteins, humic acids; vegetable material, bacteriae and algae; fresh sludge, sewage sludge and fermentations sludge from waste water purifying plants; the organic components of private or industrial garbage; and peat and brown coal are used for the present process of conversion.

It is preferred to admix a conversion catalyst to the organic starting material before heating. As catalyst an aluminum oxide, an aluminum salt, phosphoric acid, phosphates, borates, silica gel, silicates, aluminum silicate or an oxide of a transition metal or a mixture of these catalysts, respectively, can be employed. An oxide from the group consisting of Ti, V, Cr, Mn, Fe, Co, Ni, Cu or Zn or a mixture of these oxides, respectively, or a mixture of at least one of these oxides together with at least one of the compounds mentioned above is used. Especially preferred are aluminum oxide, montmorillonite, mixed catalysts out of aluminum oxide/copper oxide, aluminum oxide/vanadium pentoxide and aluminum oxide/nickel oxide.

The conversion temperature is preferably about 220° to about 380° C., especially about 250° to about 350° C., and further preferred about 280° to about 330° C. A temperature of about 300° C. is the most preferred.

It is preferred to heat the organic starting material at a rate of about 5° to about 30° C. per minute under the exclusion of air up to the conversion temperature. Still preferred one elects a heating rate of about 10 to about 20° C. per minute.

The amount of catalyst is in general 0.01 to 10% by weight, preferably 0.1 to 6% by weight, based on the weight of the used organic starting material.

In case the starting material consists mainly out of cellulose and carbohydrates (for instance material of vegetable origin) coal is the main product obtained. In case the starting material consists mainly out of proteins and lipids (for instance bio-mass on the basis of microorganisms) then the product of conversion consists mainly out of oils and hydrocarbons.

According to the process of the invention almost 70 to 90% of the carbon originally being present in the used material is converted into coal and oil. The other carbon escapes as a gaseous mixture of $CO_2$, CO, $CH_4$ and lower hydrocarbons. The heat of combustion of the oils thus obtained is between 7 000 and 10 000 kcal/kg depending on the starting material, reaction condition and catalyst. The heat of combustion of the coal formed amounts to about 3 000 and 8 000 kcal/kg depending on the amount of the inorganic residues present in the coal. The oils obtained are free of inorganic residues and relatively pure in sulfur (0.05 to 1.0% by weight S). In this respect they can be compared with the best petroleum having a sulfur content of 0.3 to 6% by weight.

The process of the invention is preferably suited for working up and converting sewage sludge and fermentation sludge as obtained from the biological waste water purifying plants. This sludge is first mechanically drained (dewatered) in filter presses or centrifuges up to a water content of about 40 to 60% by weight. This water content is additionally reduced by either drying in the air or by heating so that a dry, solid bulk material of powdery or granular type is obtained. This material is used for the process of the invention. One heats slowly under the exclusion of air whereby water is first evaporated which condenses and is collected. The elimination of the heterofunctional groups starts at about 180° to 200° C. This elimination increases strongly at about 250° C. and ceases slowly above 320° C. During this process carbon dioxide, carbon monoxide, ammonia, hydrochloric acid, hydrogen sulfide and lower hydrocarbons from methane to hexane are formed. Ammonia, hydrogen chloride, hydrogen sulfide and a part of the carbon dioxide condense together with water to give harmless ammonium salts and are removed as such from the vapor-phase. Therefore the escaping gases are free of basic substances and contain $CO_2$, CO, $CH_4$ and lower hydrocarbons as principal components. About 5 liters of gas having a calorific value of 18 600 kJ/$m^3$ are obtained from 1 kg of sewage sludge.

Since no C—C bonds are cleaved by the low temperature conversion of the invention—which is in contrast to the pyrolysis—it is understandable that only a small amount of gas is obtained. This gas serves as a protective gas during the conversion process and prevents thereby the access of air.

The higher hydrocarbons and oils obtained during the conversion escape from the reaction vessel as gases or vapors, respectively. They are liquefied together and refined later on. With respect to the petroleum the oil of conversion thus obtained has the advantage that it does not contain any bitumen and tar which can hardly be utilized. The oil of conversion can be easily processed further for instance by Crack-processes for obtaining gasoline since the oil of conversion can be evaporated quantitatively. Furthermore analytical investigations of the oil of conversion obtained according to the process of the invention have shown that branchless hydrocarbons and fatty acids can make up to 50% by weight. The fraction of the fatty acids can be easily removed from the oil. It represents a valuable industrial starting material the price of which is momentarily higher than that one of pretroleum. The same holds true for the branchless hydrocarbons. If desired the fatty acids can also be converted into hydrocarbons in a manner known per se.

Since the carbon compounds present in the sewage sludge are converted mainly into oil during the conversion the residue obtained at the end of the converstion process is relatively poor in carbon. However, it is possible to burn it directly if the common precautions with respect to the heavy metals eventually being present, especially mercury and cadmium, are taken.

The sulfur and nitrogen content of the coal residue is relatively low. It is therefore possible to hydrogenate the coal or to use it for the production of water gas.

The process of the invention is preferably performed in a continuous manner by continuously transporting the dry starting material, for instance the dried sewage sludge, being present as powder or as a granulated material, through a heated reaction tube with the aid of for instance a screw conveyor.

In general, the conversion process is finished after 2 to 3 hours.

In case sewage sludge is used for the conversion it is in most cases superfluous to add a catalyst material since the inorganic components present in the sewage sludge contain in most cases a sufficient amount of silicates, aluminum compounds and transition metals. The industrial conversion of this material is therefore facilitated substantially.

The following examples are given in illustration of, but not in limitation of the present invention.

EXAMPLE 1

100 g of albumin are heated under the exclusion of air to 230° C. for 3 hours to give 30 g of an oil and 42 g of a solid, carbon-like product.

Oil: C 70.5%; H 12.1%; heat of combustion 7 500 kcal/kg Coal residue C 79%; heat of combustion 8 200 kcal/kg.

EXAMPLE 2

100 g of dried sewage sludge (C 44%; H 6.66%; N 8.39%; 20% residue) are heated under the exclusion of air up to 320° C. for 2.5 hours. 35 g of an oil and 41 g of a solid, carbon-like product are obtained.

Oil: C 66.1%; H 8.4%; N 7.5%; S 0.32%. Heat of combustion 7 100 kcal/kg.

Carbon residue: 35.39% C; 1.7% H; 5.76% N.

Residue: 49.85%; heat of combustion 3 100 kcal/kg.

EXAMPLE 3

100 g of a dried sewage sludge are admixed with 5 g of $Al_2O_3$ and 0.1 g CuO and heated for 3 hours up to 300° C. under the exclusion of air. 42 g of an oil and 39 g of a solid product containing carbon are obtained.

Oil: C 75.9%; H 10.2%; N 2.08%; S 0.05%;

Heat of combustion: 8 900 kcal/kg.

Carbon-like residue: C 40.1%; H 1.8%; N 4.8%; S 1.26%; Residue 42.5%; heat of combustion 3 600 kcal/kg.

EXAMPLE 4

100 g of a dried mass of bacteriae (streptomyces species) are heated with 5 g of anhydrous montmorillonite under the exclusion of air up to 350° C. for 2 hours to give 47 g of an oil and 34 g of a solid residue containing carbon.

Oil: C 62%; H 12.5%, N 3.2%; S 0.3%; Heat of combustion 7 800 kcal/kg.

Residue containing carbon: C 52%; H 1.5%; N 3.2%; S 0.5%; Residue 30.7%; heat of combustion 5 100 kcal/kg.

EXAMPLE 5

100 g of a dried sewage sludge are mixed with 1 g of $Al_2O_3$ and 0.01 g of $V_2O_5$ and heated under the exclusion of air up to 400° C. for 3 hours to give 33 g of an oil and 59 g of a residue.

Oil: C 75.2%; H 11.2%; N 5.06%; S 0.15%.

Residue containing carbon: C 37.2%; H 1.6%, residue 47.2%.

Instead of $V_2O_5$ also 0.1 g of NiO can be added.

EXAMPLE 6

100 g of sewage sludge are mixed with 1 g of $Al_2O_3$ and heated for 2 hours up to 280° C. to give 29 g of an oil and 51 g of a solid product containing carbon.

Oil: C 70.2%; H 10.1%; N 6.1%; S 0.4%; heat of combustion 6 950 kcal/kg

Residue containing carbon: C 38.9%; H 3.3%; N 6.4%; S 1.4%;

Residue: 42.1%.

EXAMPLE 7

100 g of cellulose are heated under the exclusion of air up to 250° C. for 3 hours to give 5 g of an oil and 50 g of a residue containing carbon.

Residue containing carbon: C 80.5%; H 2.4%; heat of combustion 7 100 kcl/kg.

EXAMPLE 8

100 g of starch are heated with 5 g of $Al_2O_3$ under the exclusion of air up to 210° C. for 3 hours to yield 52 g of a residue containing carbon and 4 g of an oil.

Residue containing carbon: C 78.8%; H 3.2%; heat of combustion 7 000 kcal/kg.

EXAMPLE 9

100 g of humic acid from brown coal are mixed with 1 g of $Al_2O_3$ and 0.1 g of CuO and heated under the exclusion of air up to 390° C. Yield 10 g of an oil and 51 g of a residue containing carbon.

Oil: C 78.9; H 11.4%, N 1.5%; S 0.1%; heat of combustion 9 200 kcal/kg.

Residue containing carbon: C 80.1%; H 3.2%; N 1.5%; S 0.3%; heat of combustion 7 100 kcal/kg.

EXAMPLE 10

100 g of private garbage finely pulverized are mixed with 1 g $Al_2O_3$ and 0.1 g of CuO and heated under the exclusion of air up to 360° C. for 4 hours to yield 20 g of an oil and 51 g of a residue containing carbon.

Oil: C 71.2%; H 11.3%; N 1.0%; S 0.3%.

Residue containing carbon: C 43.4%; H 3.75%; N 1.5%; S 0.7%;

Residue 37.0%.

What is claimed is:

1. A process for producing a petroleum-type liquid fuel comprising de-watering an organic starting material selected from the group consisting of fresh sludge, sewage sludge, fermentation sludge from waste water purifying plants, and organic components of private or industrial garbage to obtain a dry, solid bulk material of powdery or granular consistency, subjecting said dry material to heating under the exclusion of air under such conditions that no substantial cleavage of carbon-carbon bonds takes place, said heating being carried out at a rate of 5° C. to 30° C. per minute up to a conversion temperature until the development of gases and vapors has substantially ceased, isolating the gases and vapors from the remaining solid residues and separating the liquid contained in the isolated gases and vapors whereby a petroleum-type fuel is produced.

2. The process of claim 1 wherein said isolated gases and vapors are subjected to condensation whereby said petroleum-type fuel is produced.

3. The process of claim 1 wherein said conversion temperature is a maximum of about 400° C.

4. The process of claim 3 wherein said conversion temperature is at least 200° C.

5. A process according to claim 1 wherein a conversion catalyst is admixed to the organic starting material before heating.

6. A process according to claim 1 wherein a catalyst selected from the group consisting of aluminum oxide, and aluminum salt, phosphoric acid, a phosphate, a borate, silica gel, a silicate, an aluminum silicate and an oxide of a transition metal and a mixture of these catalysts is used.

7. A process according to claim 6 wherein an oxide of a transition metal selected from the group consisting of Ti, V, Cr, Mn, Fe, Co, Ni, Cu and Zn or a mixture of these oxides or a mixture of at least one of these oxides together with at least one of the other compounds mentioned in claim 6 is used.

8. A process according to claim 6 wherein a catalyst selected from the group consisting of $Al_2O_3$, montmorillonite, $Al_2O_3$*CuO, $Al_2O_3$*$V_2O_5$ or $Al_2O_3$*NiO is used.

9. A process according to claim 1 wherein a conversion temperature of 250° to 350° C. is applied.

10. A process according to claim 9 wherein a conversion temperature of 280° to 330° C. is applied.

11. A process according to claim 10 wherein a conversion temperature of about 300° C. is applied.

12. A process according to claim 1 wherein the heating rate is 10° C. to 20° C. per minute.

13. A process according to claim 1 wherein the organic starting material is sewer sludge or fermentation sludge obtained from biological waste water purifying plants.

14. A process according to claim 13 wherein the organic starting material is sewer sludge.

15. A process according to claim 1 wherein the yield of petroleum-type fuel produced is at least 20% by weight of the dewatered starting material.

16. A process for producing a petroleum-type liquid fuel consisting essentially of de-watering an organic starting material selected from the group consisting of fresh sludge, sewage sludge, fermentation sludge from waste water purifying plants, and organic components of private or industrial garbage to obtain a dry, solid bulk material of powdery or granular consistency, subjecting said dry material to heating under the exclusion of air under such conditions that no substantial cleavage of carbon-carbon bonds takes place, said heating being carried out at a rate of 5° C. to 30° C. per minute up to a conversion temperature until the development of gases and vapors has substantially ceased, isolating the gases and vapors from the remaining solid residues and separating the liquid contained in the isolated gases and vapors whereby a petroleum-type fuel is produced.

* * * * *